United States Patent [19]

Matsumoto

[11] 4,307,486

[45] Dec. 29, 1981

[54] HINGE STRUCTURE

[75] Inventor: Seihachi Matsumoto, Tokyo, Japan

[73] Assignee: Matsumoto Manufacturing Company, Ltd., Tokyo, Japan

[21] Appl. No.: 86,259

[22] Filed: Oct. 18, 1979

[30] Foreign Application Priority Data

Oct. 11, 1978 [JP] Japan ..... 53/124916

[51] Int. Cl.[3] ..... E05F 1/12

[52] U.S. Cl. ..... 16/261; 16/304

[58] Field of Search ..... 16/189, 180, 171, 135, 16/261, 304, 307, 259

[56] References Cited

U.S. PATENT DOCUMENTS

| | | | |
|---|---|---|---|
| 401,978 | 4/1889 | Spruce et al. | 16/189 |
| 504,403 | 9/1893 | Pomeroy | 16/189 |
| 655,606 | 8/1900 | Clark | 16/189 |
| 694,670 | 3/1902 | Schiek | 16/189 |
| 3,242,523 | 3/1966 | Daley | 16/171 |

*Primary Examiner*—Peter P. Nerbun

*Attorney, Agent, or Firm*—L. Lawton Rogers, III

[57] ABSTRACT

In a hinge structure, members to be joined to each other each have curved edge portions spaced from each other along the edge. A cut out is formed in the inner sides of the contiguous curved edge portions, thus defining a pair of projections which face each other across a spacing d and extend from the one side of one curved edge portion toward that of the contiguous one. The curved edge portions and the projections of the two joint members thus formed are overlaid on each other, and a compressible coil spring member is inserted through the spacing d above mentioned and fitted on the pair of overlapping projections where the spring member retains the joint members in a pivotal relationship by action of its restoring force.

10 Claims, 6 Drawing Figures

HINGE STRUCTURE

BACKGROUND OF THE INVENTION

This invention relates to a hinge, and particularly to a novel hinge structure where curved edge portions of members to be joined are overlaid on each other, with a compressible, restorable cylindrical spring member being removably fitted in a section of the overlaid edge portions, thus providing a pivotal joint between the members.

Conventional hinge structures have required hinge fittings to be mounted across members which form part of building components, pieces of furniture or the like, for the purposes of providing openable arrangements of door panels, folding arrangements and the like. To provide such hinge joints, thus, not only several steps of working, such as shaping of the locations for the fittings to be mounted in, alignment thereof, screwing of the fittings, and the like have been required, but an inefficient and irksome working operation has been entailed in the respective steps. Further, in the case that such hinge fittings are used to construct collapsible freight containers, the fittings mounted on the surfaces of the wall panels have projecting portions or sharp edges which are likely to injure human bodies in contact, and are likely to be caught by external objects, resulting in breaking off the fittings by impact or stress. Moreover, presence of such hinge fittings on the wall panel outer surfaces has been not favorable to appearance of the freight containers.

Japanese utility model publication No. 5,642/1976 discloses a joint fitting formed by a portion of a member inserted into a portion of another member to be joined to the first named member, so that any separate joining pin can be dispensed with. In the disclosed joint fitting, however, one of the members has to be displaced from the other in an axial direction of the joint in order to disjoin or join the members, and when a plurality of joints are desired to be provided in series, this prior art fitting is not useful because members to be joined are not permitted to be displaced from each other.

SUMMARY OF THE INVENTION

Accordingly, one object of this invention is to provide a hinge structure which is capable of hinge-joining and disjoining members relative to each other in a simplified manner of manipulation without any necessity of screwing, interposition of a hinge pin or pins, and the like.

Another object of this invention is to provide a hinge structure which is capable of maintaining the mutual joining positions of members to be joined together in a predetermined correct position by action of a restoring force of spring means which form part of the hinge structure.

Still another object of this invention is to provide a hinge structure which has a component constituted simply by edge portions of members which have been preliminarily shaped in a determined form.

A further object of this invention is to provide a hinge structure which is adapted to use in application or joints in collapsible or manually erectable containers and other similar equipment.

A still further object of this invention is to provide a hinge structure which does not present any sharp edge or projection injurious to human bodies and whose joining positions are not subject to deformation and damage by an externally exerted impact.

A still further object of this invention is to provide a hinge structure which is capable of disjoinably hinge-joining more than two members in series by a plurality of joints, without any necessity of interposition of a hinge pin or pins.

The foregoing objects, characteristics, principle, and details of the present invention, as well as further objects and advantages thereof, will become apparent from the following detailed description with respect to a preferred embodiments of the invention, when read in conjunction with the accompanying drawings, in which like parts are designated with like reference numerals.

DESCRIPTION OF THE PREFERRED EMBODIMENTS

Figure 1:
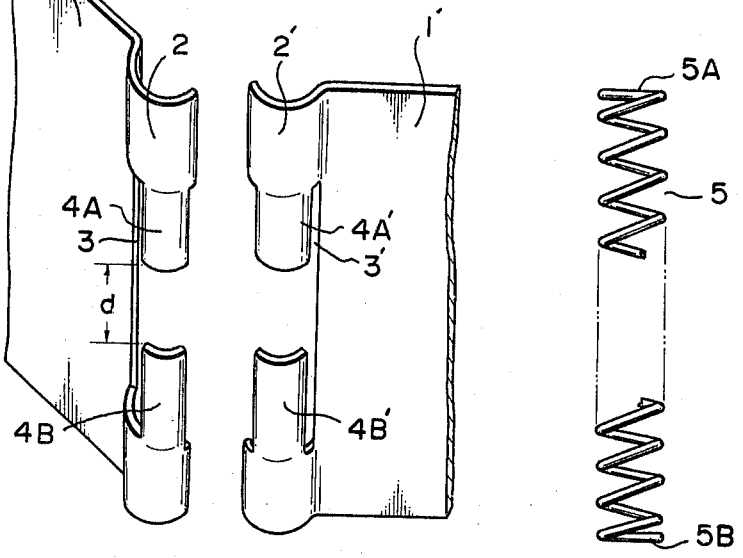
FIG. 1 is a perspective view of a hinge structure embodied by the present invention, with parts thereof broken apart.

Referring to FIG. 1, there are shown typical elements forming a hinge structure according to the present invention. Reference numeral 1 therein designates a flat member or a portion of, say, a wall panel of collapsible freight container, building component, equipment, door, etc.

The flat member 1 is provided along one edge with at least two arcuate curvatures 2 of a determined radius spaced from each other by a distance d. A cut-out 3 is formed to extend in a determined range of oppositely facing edge portions of the arcuate curvatures 2, thus defining a pair of projections 4A and 4B on the opposed sides of curvatures 2 to be spaced from each other at the spacing d in an opposed relationship to each other.

Figure 2:
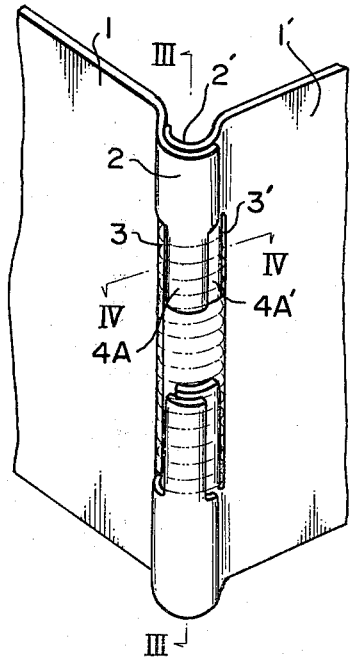
FIG. 2 is a perspective view of the hinge structure of FIG. 1 as set in a joining state with the joined members forming an angle of substantially 90 degrees therebetween.

Another flat member 1' to be hinge-joined to the flat member 1 is shaped in a substantially similar form as the flat member 1 above stated. Both flat members 1 and 1' are overlaid on each other at the curved edge portions 2 and 2', and a compressible, restorable helical cylindrical spring member, for example, coil spring 5, as compressed, is inserted through the spacing d and fitted snugly on overlapping pairs of projections 4A and 4A', and 4B and 4B' in the cut outs 3 and 3'. The coil spring 5 is then restored from the compressed state to the length which extends entirely in the cut-outs 3 and 3' as shown in FIG. 2, the respective pairs of projections 4A and 4A', and 4B and 4B' being thus retained within the coil spring 5, so that the flat members 1 and 1' are joined pivotably to each other with the curved surfaces of curved edge portions 2 and 2' abutted against each other.

The flat members used according to the invention to form a hinge structure may be made of metal, plastic, wood, glass or any other materials which can be shaped with a curved portion.

Figure 3:
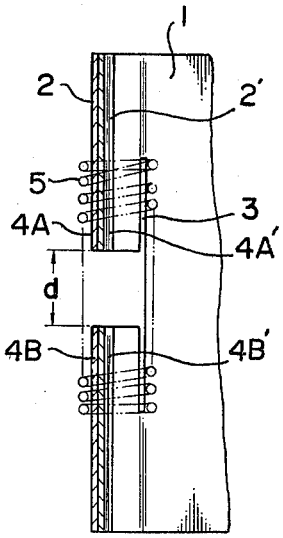
FIG. 3 is an enlarged, longitudinally sectional view taken along line III—III.
Figure 4A:
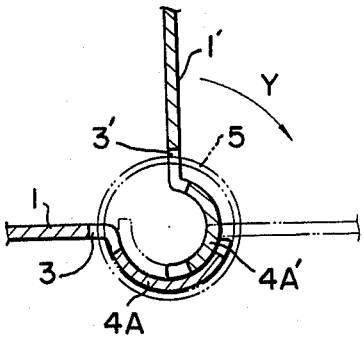
FIG. 4*a* is an enlarged, transversely sectional view taken along line IV—IV.
Figure 4B:
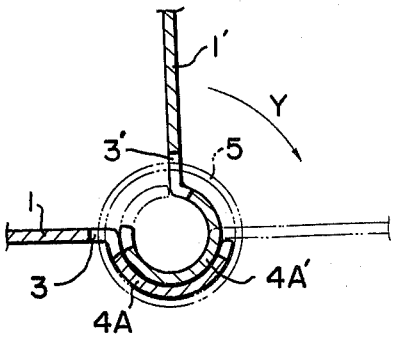
FIG. 4*b* is a similar sectional view to FIG. 4*a*, but showing another embodiment of the present invention.
Figure 5:
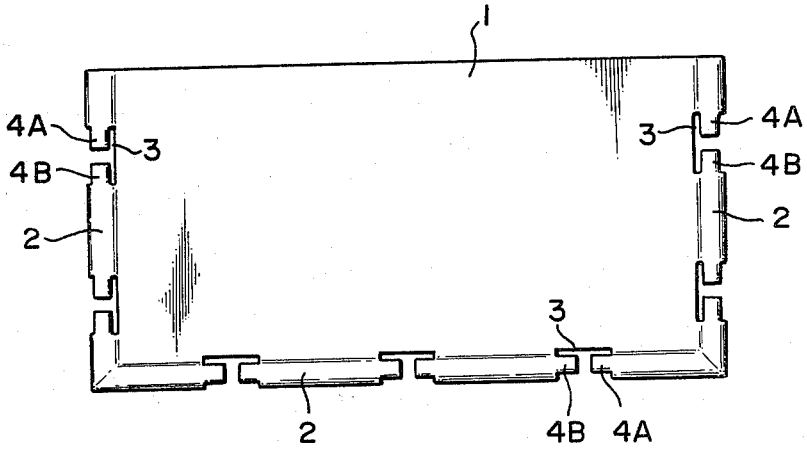
FIG. 5 is a plan view of a panel having hinge structures of the present invention.

This invention should be in no way limited to the one typical of the invention described in the foregoing. For instance, a radius of the curved edge portion of the inner flat member 1' may be slightly smaller than that of the curved edge portion of the flat member overlappingly assembled thereon. Further, the curved edge portion of the inner flat member 1' may be circular or approximately circular shape in cross section as shown FIG. 4*b*, where even when the flat members 1 and 1' have been pivoted about the hinge joint in a direction of Arrow Y to be overlaid on each other, the curved edge portions 2 and 2' are permanently maintained in a mutual overlapping relationship so that the flat members can be turned in the reversed direction in a smooth manner without any hitch or interference. Moreover, the invention is not limited to where members are joined serially one by one, nor to where one single joint is provided at one side edge of a member to be joined as shown in FIGS. 1 to 3, but rather a plurality of joints may according to the invention be provided along one side edge of a member to be joined as shown in FIG. 5, which may be desired with certain sizes and material properties of the flat members to be joined. A spring member for retaining the overlapping portions of members to be joined may be not only a coil spring as depicted, but a telescopic cylindrical member with a spring housed therein or any other cylindrical spring means which are substantially capable of being compressed from and restored to an original length.

There is thus provided according to the invention the flat members 1 and 1' which are joined to each other, with the respective pairs of projections 4A and 4A', and 4B and 4B' provided on the end edges thereof being retained in the coil spring 5, where the curved edge portions 2 and 2' overlaid on each other are of an arcuate form having a determined radius or radii for sliding movement on the contact surfaces relative to each other, thus permitting the flat members 1 and 1' to be displaced thereabout in any angular position to each other in the range between substantially 0 and 180 degrees.

The coil spring 5 serving to couple the flat member 1 and 1' tends to be restored to the original length in the cut outs 3 and 3' of the edge portions of the flat members, and thus abuts against the opposed inner ends of the cut outs 3 and 3' by action of force depending on a degree of its compression, whereby the mutual joining positions of the flat members 1 and 1' can be permanently maintained in an appropriate position. The flat members 1 and 1' can be easily disjoined by removing the coil spring 5 while compressed from between the two pairs of projections 4A, 4A' and 4B, 4B'. Preferably, the coil spring 5 may be provided at the opposed ends with flattened annular surfaces 5A so that the flat members 1 and 1' joined to each other can be turned smoothly. The curved edge portions 2 of the flat members serves not only as a retainer for mutually restraining pivotal movements of the flat members 1 and 1' to maintain the joining relationship therebetween, but as a reinforcement of the flat members 1 and 1', strength of the flat members 1 and 1' being thereby increased.

More than one hinge structures of the invention may be provided along any side of the flat members. The structure of the present invention is so much simplified that flat members preliminarily shaped in a determined form may be simply combined with a compressible coil spring to provide a hinge structure. Such a hinge structure is free of any outward projection, and when applied to wall panels for erecting freight containers, permits provision of container products which are not injurious to human bodies, and are prevented from being damaged due to an externally exerted force, presenting a good appearance.

Of course, a hinge fitting may be provided according to this invention where a pair of shaped flat pieces are combined with a compressible coil spring. The hinge structure of this invention may, however, be provided directly on a wall panel which form part of a product. As shown in FIG. 5, for instance, a wall panel 1 may preliminarily be provided along the respective sides with curvatures 2 and cut outs 3 in curvatures 2 with projections 4A, 4B, so as to dispense with the steps of mounting separate pieces of hinge on panels to be hinge-joined, as required in the prior art. It is apparent that the present invention can advantageously simplify assembly of the hinged products. A support pin may be interposed between the projections in combination with the coil spring, thereby preventing any tendency of dislodgement of the coil spring.

It is apparent that a hinge structure of this invention could be applied for hinge-joining any members in erectable freight containers, building components, installations and equipment.

Although detailed descriptions have been made exclusively on the foregoing typical embodiments of this invention, it should be understood, as indicated hereinbefore, that the preferred embodiments as described and shown herein do not mean in any way limitations of this invention thereto, but on the contrary, many changes, variations and modifications with respect to the construction and arrangement in practice thereof may further be derived by those skilled in the art to which the present invention pertains, whereby the advantageous characteristics of this invention may be realized without departing from the spirit and scope of the invention as set forth hereunto in the appended claims.

What is claimed is:

1. A hinge structure comprising:

a pair of joint members each having contiguous therewith a pair of curved edge portions spaced from each other by a determined distance along the joining edges, said contiguous curved edge portions having mutually facing pairs of projections on the opposedly facing sides thereof across a determined spacing, said curved edge portions of said pair of joint members being overlaid on each other; and a compressible, restorable cylindrical spring member inserted through the spacing between said projections and snugly fitted on the circumferences of one of said mutually facing pairs of projections by action of a restoring force to maintain said curved edge portions in substantial registration.

2. The hinge structure defined in claim 1 where an interiorly lying one of said curved edge portions of the joint members is circularly formed.

3. The hinge structure defined in claim 1 where said compressible restorable cylindrical spring member is constituted by a compressible coil spring.

4. The hinge structure defined in claim 3 where said coil spring is provided at each of the opposed ends with a flattened annular surface.

5. A hinge structure comprising:

a first joint member having a pair of curved edge portions, each of said edge portions having a projection extending toward the other of said edge portion but being spaced therefrom;

a second joint member having a pair of curved edge portions, each of said edge portions having a projection extending toward the other of said edge portions but being spaced therefrom, the curved edge portions of one of said first and second joint members being configured to closely overlie the curved edge portion of the other of said first and second joint members for relative rotational movement;

a spring member compressible sufficiently to pass between the projections of the curved edge portions of said first and second joint members when the curved edge portions of said first and second joint members are disposed in an overlying relationship one to the other whereby said spring member may be positioned between said projections for expansion over said projections, said spring member being normally expandable to a distance greater than the spacing between the curved edge positions of said first and second joint members so that said spring member, when positioned over the overlying projections of said joint members, will apply a force tending to maintain the base of said projections in substantial registration.

6. The hinge structure defined in claim 5 wherein said spring member, when positioned over the overlying projections of said joint members, will limit the separation of said overlying projections in a direction normal to the longitudinal axis of said projections.

7. The hinge structure defined in claim 6 wherein said spring member is a coil spring having an inside diameter slightly larger than the outside diameter of the locus of curvature of the exteriorally lying one of the curved edge portions of said first and second joint members.

8. The hinge structure defined in claim 7 wherein said coil spring is provided with a flattened annular surface at opposite ends thereof for pressural engagement with said curved edge portions.

9. The hinge structure defined in claim 5 wherein said spring member is a coil spring having an inside diameter slightly larger than the outside diameter of the locus of curvature of the exteriorally lying one of the curved edge portions of said first and second joint members.

10. The hinge structure defined in claim 9 wherein said coil spring is provided with a flattened annular surface at opposite ends thereof for pressural engagement with said curved edge portions.

* * * * *